United States Patent [19]

Glover

[11] 4,403,717

[45] Sep. 13, 1983

[54] CAMERA CARRYING DEVICE

[76] Inventor: Betty L. Glover, 3132 Silverado Dr., Los Angeles, Calif. 90039

[21] Appl. No.: 341,931

[22] Filed: Jan. 22, 1982

[51] Int. Cl.[3] ..... A45F 5/02

[52] U.S. Cl. ..... 224/252; 224/268; 224/269; 224/908

[58] Field of Search ..... 224/908, 904, 909, 197, 224/252, 253, 268, 148, 234, 255, 269, 912; D2/381, 400

[56] References Cited

U.S. PATENT DOCUMENTS

| | | | |
|---|---|---|---|
| D. 203,101 | 12/1965 | Holder | 224/252 X |
| D. 268,300 | 3/1983 | Richards | D2/400 |
| 1,270,158 | 6/1918 | Hill | 224/904 |
| 1,797,098 | 3/1931 | Minehart | 224/268 |
| 2,400,626 | 5/1946 | Brede | 224/252 X |
| 3,209,968 | 10/1965 | Flanagan | 224/908 X |
| 3,608,794 | 9/1971 | Mazure | 224/257 X |
| 3,990,617 | 11/1976 | Carter | 224/252 X |
| 4,072,256 | 2/1978 | Young | 224/269 X |
| 4,177,910 | 12/1979 | Gangl | 224/252 |
| 4,266,706 | 5/1981 | Gould | 224/253 |

*Primary Examiner*—Steven M. Pollard
*Assistant Examiner*—David Voorhees
*Attorney, Agent, or Firm*—Nilsson, Robbins, Dalgarn, Berliner, Carson & Wurst

[57] ABSTRACT

A camera carrying device includes a body portion having an upper edge and lower edge. A pair of hook clips for attachment to the strap rings of a camera are interconnected to extend from the corner region along the upper edge of the body portion. The lower edge of the body portion is bent upwardly to define a channel opening in the direction of the upper edge. The first and second hook clips are positioned through the strap retaining rings to thereby hook the camera carrying device to the camera so that the lens of the camera either points outwardly away from the user or downwardly towards the ground. The body portion of the camera carrying device is inserted between the belt or strap worn by a user and the user's body with the channel hooked around the lower edge of the user's belt or strap. Alternatively, the channel can be hooked over the top of the belt or strap with the body portion between the belt and the user's body or the belt between the body portion and the user's body.

6 Claims, 3 Drawing Figures

CAMERA CARRYING DEVICE

BACKGROUND OF THE INVENTION

The present invention relates to camera accessories and in particular to a camera carrying device by which a camera can be attached to a belt or strap worn by a user.

When a person engaged in outdoor activities is carrying a camera, it is often difficult or inconvenient to retrieve the camera from a typical protective case provided by the manufacturer to take the desired photograph. Typically, the camera is suspended from a strap which is carried over the person's neck or shoulder with the protective case positioned around the camera in such a way that the camera flops around and is constantly in the way.

To overcome these disadvantages, a camera carrying device in accordance with the present invention provides a rigid member which is attachable to the rings on either side of the camera normally used to attach the strap. The rigid member can then be inserted into the user's belt, backpack, or like with the rigid member positioned between the belt or strap and the user's body. In accordance with the invention, the rigid member may be attached to the camera so that the back of the camera is adjacent to the user and the lens is facing outwardly away from the user or alternatively by reversing the attachment orientation of the camera and camera carrying device, the camera can be carried with the lens directed downwardly. This latter interconnection is particularly desirable when a large lens such as a telephoto lens is attached to the camera.

Heretofore various camera carrying devices have been devised for attachment to a belt and to a camera. For example, Wolfe design U.S. Pat. No. 236,916 shows a device which clips around the edge of the camera which has a spring like member for insertion between the waist band and the user. However, this camera clip is not attachable to the strap rings of the camera and in any event is configured so that the camera can only be positioned to point outwardly from the wearer. There is no position whereby the device can be interconnected to the camera so that the lens of the camera is held in a down pointing position.

Similarly, Linn et al. design U.S. Pat. No. Des. 240,094 shows a belt attached camera carrier which interconnects to the camera by the lower screw normally used to attached the camera case to the camera. This device similarly does not attach to the strap rings of the camera and is not configured so that camera lens can be either pointed outwardly or downwardly.

A substantially similar camera carrier with like disadvantages is illustrated in French Pat. No. 76 33200 issued to Petit.

A two position camera carrying accessory device is shown in Flanagan U.S. Pat. No. 3,209,968. Although this camera accessory device allows the camera to be held in either of two different positions, the lens extends outwardly from the body of the user and there is no possibility of an interconnection between the device and the camera whereby the lens can be pointed in a downward direction. In any event, the device of Flanagan is attached to the case attachment screw rather than to the strap rings.

Finally, belt attachment devices are shown in Mayer U.S. Pat. No. 2,328,915 for a fishing accessory and Hopkins U.S. Pat. No. 520,053 for a portable umbrella holder. While both of these devices show a hook-like mechanism for attachment over the top of the belt, neither of these devices permit inversion of the hook-like device so that the groove fits around the lower edge of the belt or strap rather than over the upper edge of the belt or strap. Furthermore, neither of these described devices disclose a camera carrying mechanism which is attached to the strap rings which allow a camera to be carried either with the lens pointing outwardly from the user or pointing downwardly toward the ground relative to the user.

SUMMARY OF THE INVENTION

The present invention comprises a camera carrying device for attachment to the pair of strap attachment rings on a camera for positioning between a user's body and a belt or strap worn by the user whereby the camera can be carried without flopping and yet be readily accessible. The camera carrying device is a unitary member having a first or top edge and a second or bottom edge generally parallel to the first edge. The second edge is bent to an angle of approximately 180 degrees thereby defining a strap receiving groove along the length of the second edge opening in the direction of the first edge. In such a configuration the unitary member extends around one edge of a belt or strap with the belt or strap being positioned in the strap receiving groove. The unitary member further has a pair of hook clips one at each corner region along the first edge, for receiving and retaining one of the strap attachment rings of the camera.

In one arrangement, the hook clips are attachable to the camera so that the lens of the camera points outwardly away from the person with the unitary member position between the strap or belt worn by the user and the body of the user with the second edge extending around the edge of the strap or belt.

Alternatively, the camera can be inverted so that the rings can be attached to the opposite hook clips so that the lens of the camera points downwardly relative to the user when the unitary member is positioned between the strap and the belt worn by the user and the body of the user with the second edge extending around the edge of the strap or belt.

A BRIEF DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

Figure 1:
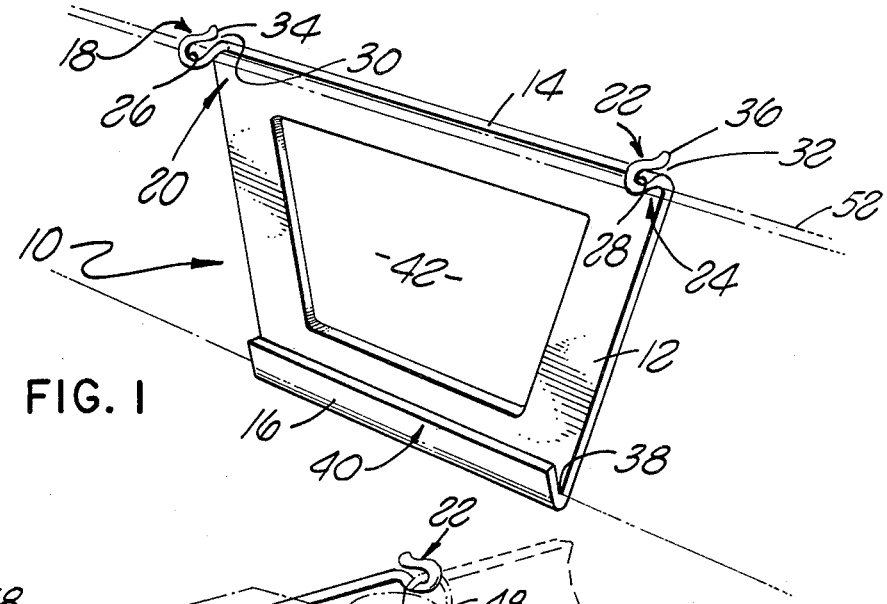
FIG. 1 is a perspective view of the unitary camera carrying device in accordance with the invention.

Referring initially to FIG. 1, a camera carrying device 10 in accordance with the invention includes a body portion 12 having an upper or first edge 14 and a lower or second edge region 16 which is generally parallel to the upper edge 14. The upper edge 14 has a first hook clip 18 interconnected to a first corner region 20 and a second hook clip 22 extending from a second corner region 24 spaced from the first corner region 20.

The hook clips 18 and 22 are made from a resiliently deformable material and are formed to define a looped portion 26 and 28 with a normally closed entrance region 30 and 32 respectively. The loop regions 26 and 28 terminate in upturned leg portions 34 and 36 respectively which are resiliently deformable to enable the entrance region 30 and 32 to be forced open thereby enabling a pair of strap attachment rings on the camera to be inserted into the center region of each hook clip 18 and 22 to thereby interconnect the camera carrying device 10 to a camera.

The lower edge region 16 is bent to define a U-shaped channel 38 defining a reverse hook 40 opening in the direction of the upper edge 14.

In the preferred embodiment, the camera carrying device is made out of a rigid material such as hard plastic or metal and is a unitary device. Alternatively, the hook clips may be separate members which are welded or otherwise joined to the body portion 12. In addition, the body portion 12 preferably has a large opening 42 through its center to both reduce the weight and material cost of the camera carrying device 10.

Figure 2:
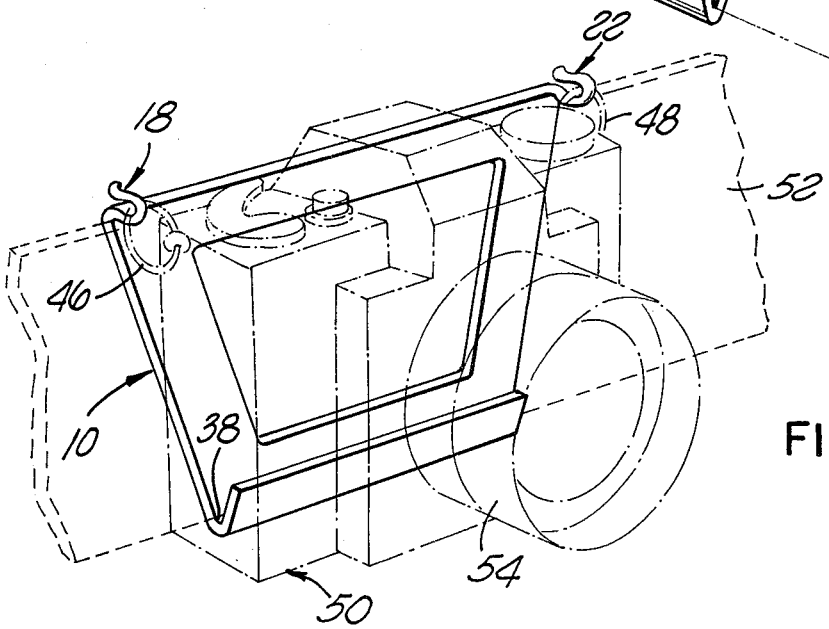
FIG. 2 is a perspective view of a camera attached to the camera carrying device in accordance with the invention so that the camera lens is pointing outwardly from the person.

Referring to FIG. 2, the camera carrying device 10 in accordance with the invention, may in one mode, be attached using the hook clips 18 and 22 to the pair of strap attachment rings 46 and 48 on either side of a conventional camera 50. The camera 50 may be held by a person utilizing the camera carrying device 10 by attaching the camera carrying device 10 so that the body portion 12 is adjacent to the back of the camera 50 with the strap or belt 52 worn by the user positioned between the body portion 12 and the back of the camera so that the portion 12 is held firmly between the belt or strap 52 and the user's body. The channel 38 defined by the upturned lower edge region 16 is positioned around the lower edge of the belt or strap 52 to thereby permit the body portion 12 to grasp under the belt or the strap 52.

By interconnecting the camera carrying device 10 in this manner the back of the camera 50 will be adjacent to the body of the user with the lens 54 of the camera 50 pointing outwardly away from the body of the user.

Figure 3:
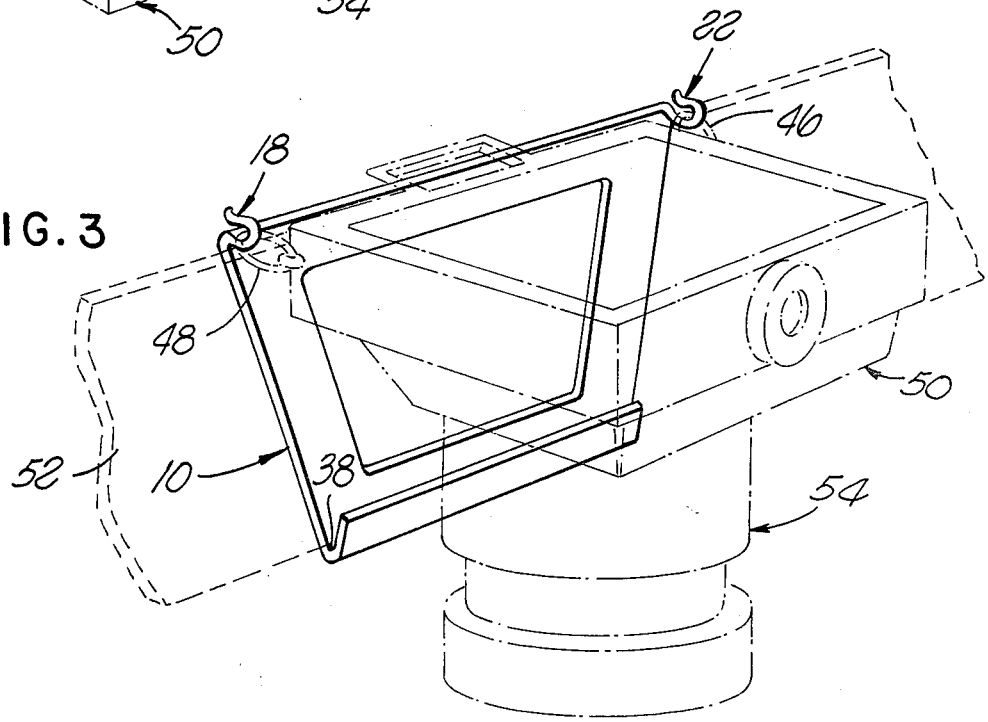
FIG. 3 is a perspective view of a camera attached to the camera carrying device in accordance with the invention in such a way that the lens of the camera points downwardly.

Referring to FIG. 3, one particular advantage of the present invention is that the camera can be reversed relative to the first and second hook clips 18 and 22 whereby the lens 54 of the camera 50 will be facing downwardly generally parallel to the user's body rather than perpendicularly away from the user's body as shown in FIG. 2. Such a carrying position allows a camera with a large lens such as a telephoto lens to be easily carried on the belt or strap 52 where the body portion 12 of the camera carrying device 10 is inserted and held between the belt or strap 52 and the body of the user wearing the belt or strap.

In still an alternative arrangement, the camera carrying device can be attached to the camera in such a way that the channel portion is hooked over the top of the belt or strap 52 with the body portion 12 being either adjacent the outside of the belt or strap with the belt or strap 52 positioned between the body of the user and the body portion 12 or between the belt or strap 52 and the body of the user.

The present invention therefore comprises a versatile yet simple camera carrying device which enables the user to quickly and easily remove the canera from its carrying position for use while holding the camera so that it does not flop about when not in use.

While the above invention has been described in connection with the preferred embodiment, it will be understood that various changes and modifications can be made in the specific structure of the invention without departing from the invention in its broader aspects. It is therefore the purpose of the appended claims to incorporate all such modification and variations as fall within the true spirit and scope of the invention.

What is claimed is:

1. A camera carrying device for attaching a camera having a pair of strap attachment rings on each side of the camera, to a belt or strap worn by a user, the camera carry device comprising:

a rigid body having an upper edge, a lower edge portion generally parallel to the upper edge and a pair of corner regions along the upper edge;

a pair of hook clips each extending from one of the corner regions, each hook clip for being clipped to one of the strap attachment rings on the camera; and an upwardly directed reverse hook portion extending along the length of the lower edge portion for securing and holding the camera carry device with attached camera around the edge of the belt or strap of the user.

2. The camera carrying device of claim 1 wherein each hook clip comprises a resiliently deformable member bent to define a clip loop with a closed entrance which is resiliently openable to receive a strap attachment ring therethrough whereby the hook clip is attached to the strap attachment ring.

3. The camera carrying device of claim 2 wherein the closed entrance of each clip faces in a direction generally perpendicular to the rigid body.

4. The camera carrying device of claims 1 or 2 wherein the reverse hook portion is positioned on one side of the rigid body so that the rigid body is positionable between the user and the belt or strap worn by the user with the reverse hook portion extending in a direction away from the user and positioned around one edge of the belt or strap worn by the user.

5. The camera carrying device of claim 3 wherein the reverse hook portion is positioned on one side of the rigid body so that the rigid body is positionable between the user and the belt or strap worn by the user with the reverse hook portion extending in a direction away from the user and positioned around one edge of the belt or strap worn by the user.

6. A camera carrying device for attachment to a pair of strap attachment rings on a camera with a lens for hooking the camera to a belt or strap worn by a user whereby the camera can be carried by the user, the camera carrying device comprising: a unitary member having a first edge with a pair of corner regions and a second edge generally parallel to the first edge, the second edge being bent to extend in a direction generally toward the first edge to define a strap receiving groove opening in the direction of the first edge for receiving the strap or belt worn by the user whereby the unitary member extends around the edge of the strap or belt, the unitary member further having a pair of hook clips, each extending from the corner regions along the first edge for receiving and retaining one of the strap attachment rings on the camera for attaching the unitary member to the camera, the hook clips being attachable to the camera so that the lens of the camera points outwardly away from the user when the unitary member is positioned between the strap or belt worn by the user and the body of the user with the second edge extending around the edge of the strap or belt and alterably attachable to the camera so that the lens of the camera points downwardly relative to the user when the unitary member is positioned between the strap or belt worn by the user and the body of the user with the second edge extending around the edge of the strap or belt.

* * * * *